US007856668B2

(12) United States Patent
Demarest et al.

(10) Patent No.: US 7,856,668 B2
(45) Date of Patent: Dec. 28, 2010

(54) ARTICLE OF APPAREL FOR RESISTANCE TRAINING

(75) Inventors: Nathan Demarest, Portland, OR (US); Richard C. MacDonald, Portland, OR (US); Jorge Emilio Carbo, Jr., Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 11/529,567

(22) Filed: Sep. 29, 2006

(65) Prior Publication Data

US 2008/0078008 A1 Apr. 3, 2008

(51) Int. Cl.
*A41D 13/00* (2006.01)

(52) U.S. Cl. ..... 2/69

(58) Field of Classification Search ..... 2/69, 2/79, 2.15, 67

See application file for complete search history.

(56) References Cited

U.S. PATENT DOCUMENTS 4,443,511 A * 4/1984 Worden et al. ..... 428/198
5,337,418 A * 8/1994 Kato et al. ..... 2/456
5,380,578 A * 1/1995 Rautenberg ..... 428/172
5,423,087 A * 6/1995 Krent et al. ..... 2/463
5,784,716 A * 7/1998 Holt et al. ..... 2/69
5,819,322 A * 10/1998 Dicker et al. ..... 2/456
5,887,280 A * 3/1999 Waring ..... 2/69
6,438,755 B1 * 8/2002 MacDonald et al. ..... 2/69

* cited by examiner

*Primary Examiner*—Gary L Welch
*Assistant Examiner*—Amber R Anderson
(74) *Attorney, Agent, or Firm*—Banner & Witcoff, Ltd

(57) ABSTRACT

The apparel is an athletic garment formed from textiles for use as a resistance training tool that works by increasing the fluid resistance such as aerodynamic drag or hydrodynamic drag on an athlete in a predetermined event. The athletic garment has a first fabric for covering at least a portion of a first body segment, and a second fabric, different from said first fabric, for covering at least a portion of a second body segment; wherein the second fabric is a turbulence-generating fabric.

27 Claims, 4 Drawing Sheets

ARTICLE OF APPAREL FOR RESISTANCE TRAINING

FIELD OF THE INVENTION

The present invention relates to an article of apparel. Aspects of the invention concern, more particularly, a garment formed from textiles for use as a resistance training tool.

BACKGROUND OF THE INVENTION

Normally, in high-speed individual sports, such as speed skating, skiing, bicycling and running, it is desired to reduce air resistance or aerodynamic drag because it can significantly retard the speed of the athlete. Likewise, in sports such as swimming, it is desired to reduce water resistance or drag because such drag can significantly retard the speed of the athlete. There are apparel-related items that attempt to reduce fluid (air or water) resistance or drag.

However, during training, athletes often are not looking to increase their speed but instead are looking for ways to increase their strength and endurance, typically by increasing the effort that they must exert while training. Moreover, athletes often train at one venue, for example at a high altitude, but compete at another venue, for example at a low altitude. It would be beneficial to provide an avenue that would simulate conditions at the competition site not found at the training site such as air resistance, which is higher at lower elevations.

Current fluid resistance training devices include devices such as parachutes and resistance bands. Parachutes typically require a harness attached around the waist and a large fabric parachute attached to the body through the harness. Resistance bands connect the torso to a stationary object or a training partner.

SUMMARY

As noted in the Background section above, current resistance training devices, such as parachutes and resistance bands, either require a harness, stationary object, or training partner in use. Various configurations of the present invention relate to apparel that increases aerodynamic drag or hydrodynamic drag of an athlete as they train for their sport and thus functions as a resistance training tool. Unlike harnesses and resistance bands, however, the apparel may not require a harness, stationary object, or training partner in use. In addition, the apparel may be donned and doffed relatively easily and has application to athletes who might wear body suits when they compete, such as speedskaters, swimmers, track athletes, as well as others.

The apparel is an athletic garment formed from textiles for use as a resistance training tool that works by increasing the fluid resistance such as aerodynamic drag or hydrodynamic drag on an athlete in a predetermined event. In one configuration, the athletic garment includes a first fabric covering at least a portion of a front of a torso of an athlete, and a second fabric covering at least a portion of a back of the torso of the athlete, wherein the second fabric is a turbulence-generating fabric; and wherein turbulence is generated by fluid flow across the second fabric during movement of the athlete creating fluid resistance on the athlete.

In another configuration, the athletic garment includes a third fabric for covering the front of a first appendage of the athlete, wherein the third fabric is a turbulence-generating fabric; and wherein turbulence is generated by fluid movement across the third fabric during flow of an athlete creating fluid resistance such as aerodynamic drag or hydrodynamic drag on the athlete. Additional turbulence-generating fabrics may be used to cover additional appendages to generate additional turbulence and fluid resistance. In one aspect, the turbulence-generating fabrics provide even fluid resistance over the entire athletic garment.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

BRIEF DESCRIPTION OF THE DRAWINGS

The foregoing Summary of the Invention, as well as the following Detailed Description of the Invention, will be better understood when read in conjunction with the accompanying drawings.

DETAILED DESCRIPTION

The following discussion and accompanying figures disclose various garments that utilize turbulence generating fabric on certain body segments of the garments to provide a resistance training tool. "Garment," as used in this specification, includes any type of wearing apparel for an individual, and the wearing apparel may cover various portions of the individual, including one or more of the torso, arms, legs, and head. Accordingly, concepts related to the garments disclosed below may be applied to bodysuits, pants, shirts, gloves, hats, sleeves, and footwear, for example.

The present invention is directed to garment having strategically placed turbulence generating fabrics to cover different body parts to increase the drag force encountered by athletes during various activities. Different turbulence generating fabrics can cause differences in drag force. Consequently, specific fabrics can be selected for use over particular body segments in order to optimize an increase of wind resistance incurred by an athlete. Such optimization may be different for different athletes or types of sports and the fabrics selected may be tailored to different athletes or sports.

Figure 1:
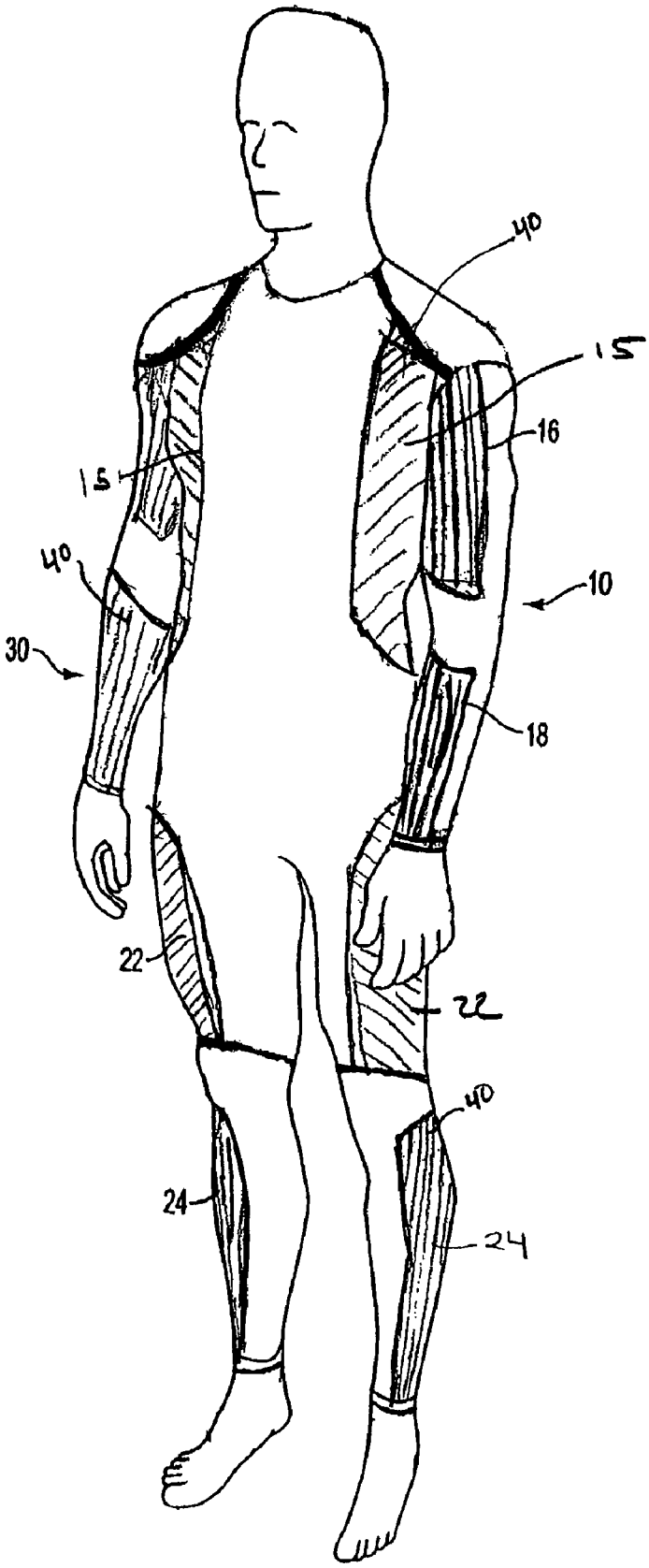
FIG. 1 is a perspective view of a front and side of an athletic suit according to the present invention.
Figure 2:
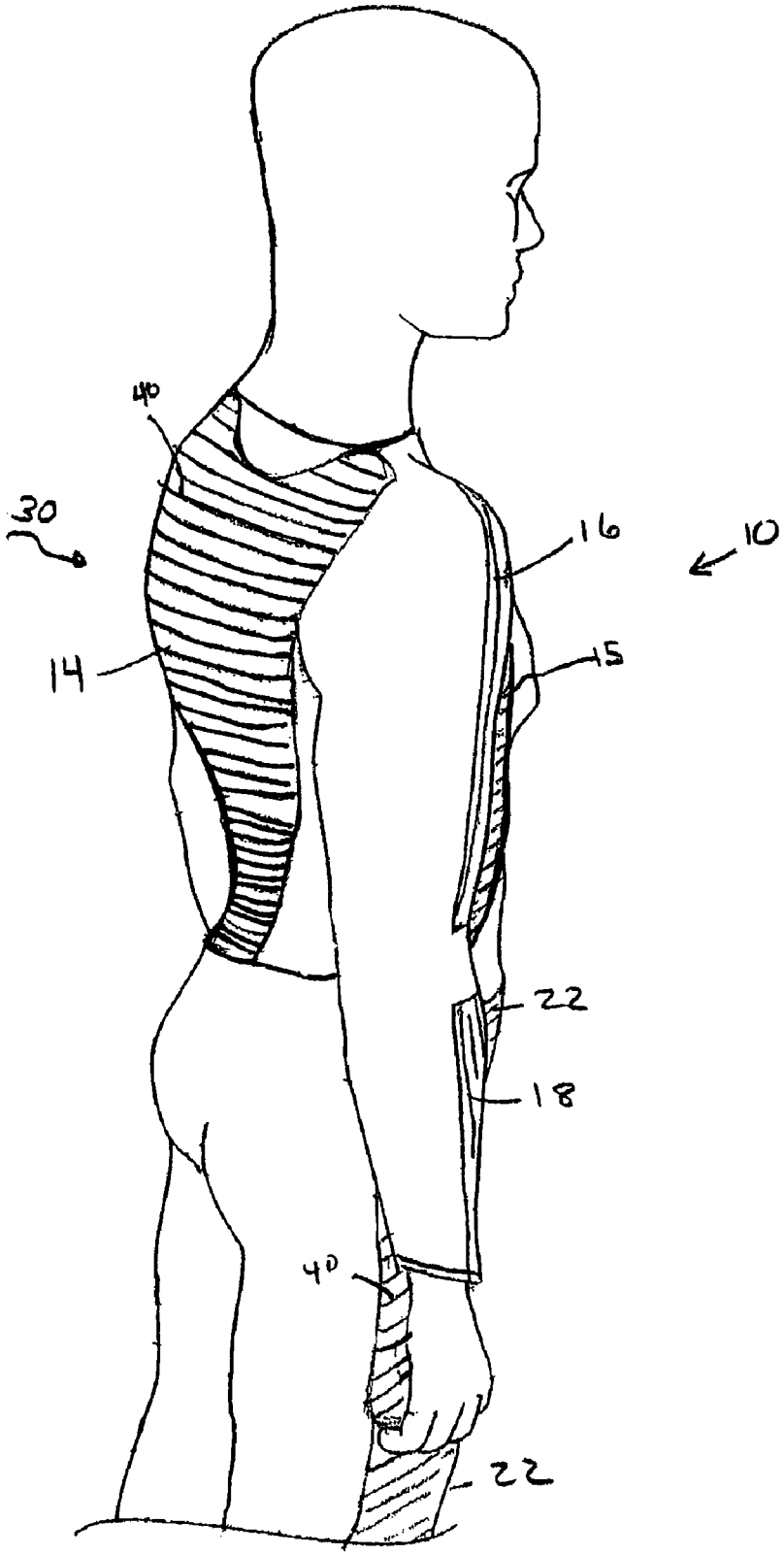
FIG. 2 is another perspective view of a side and back of the athletic suit according to the present invention.
Figure 3:
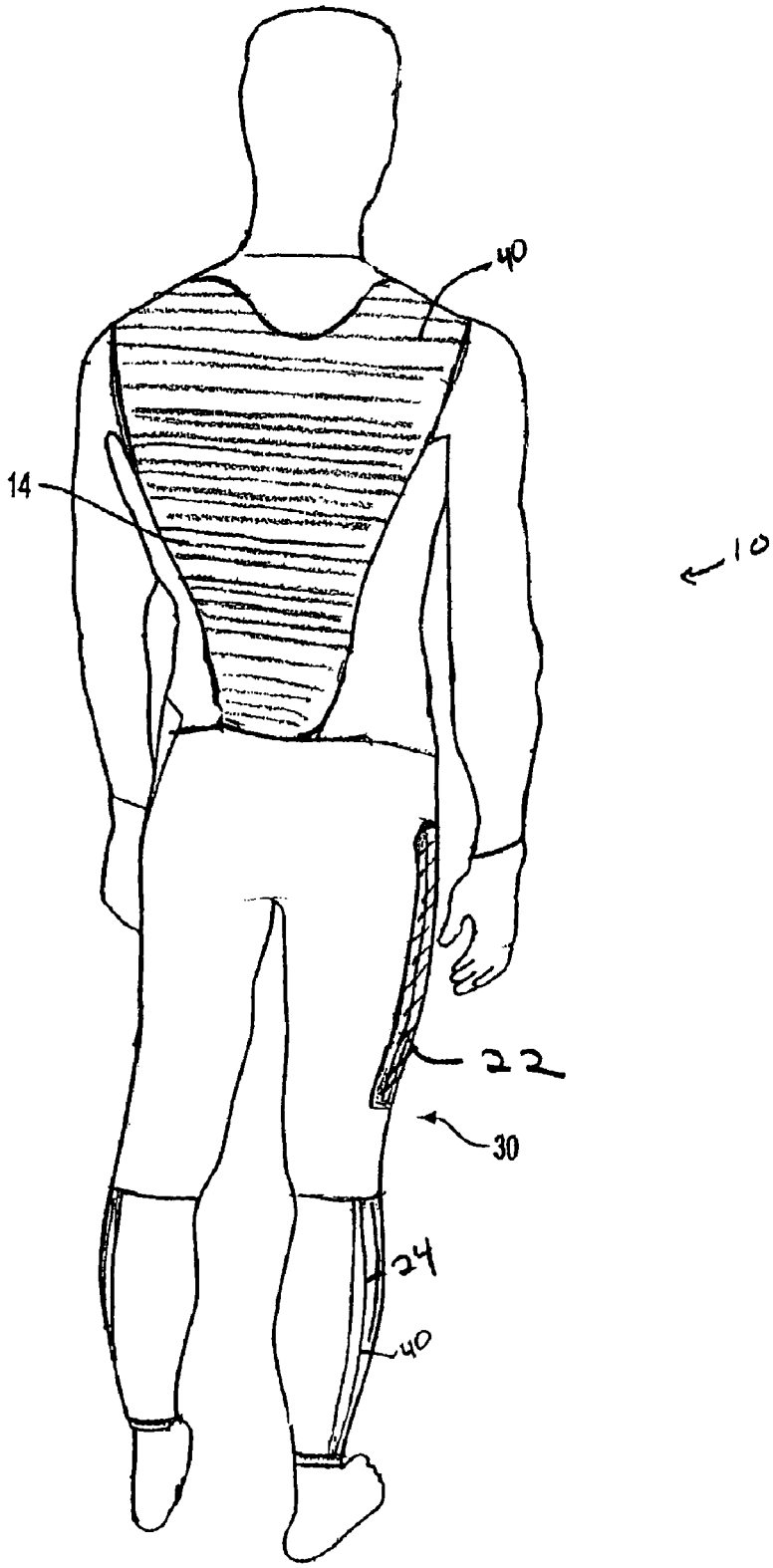
FIG. 3 is a rear elevational view of the athletic suit according to the present invention.

Referring to FIGS. 1-3, an athlete 10 is shown and various body segments are enumerated. The athlete's body is broken down into a back torso segment 14, front side torso segments 15, front upper arm segments 16 (which are generally defined as the region of the arm between the shoulder and the elbow), front lower arm segments 18 (which are generally defined as the regions between the elbow and the wrist), front upper leg segments 22 (which are generally defined as the regions between the hips and the knees), front lower leg segments 24 (which are generally defined as the regions between the knees and the ankles). The garment 30 includes body segment portions corresponding to the body segments of the athlete, enumerated above.

Figure 4:
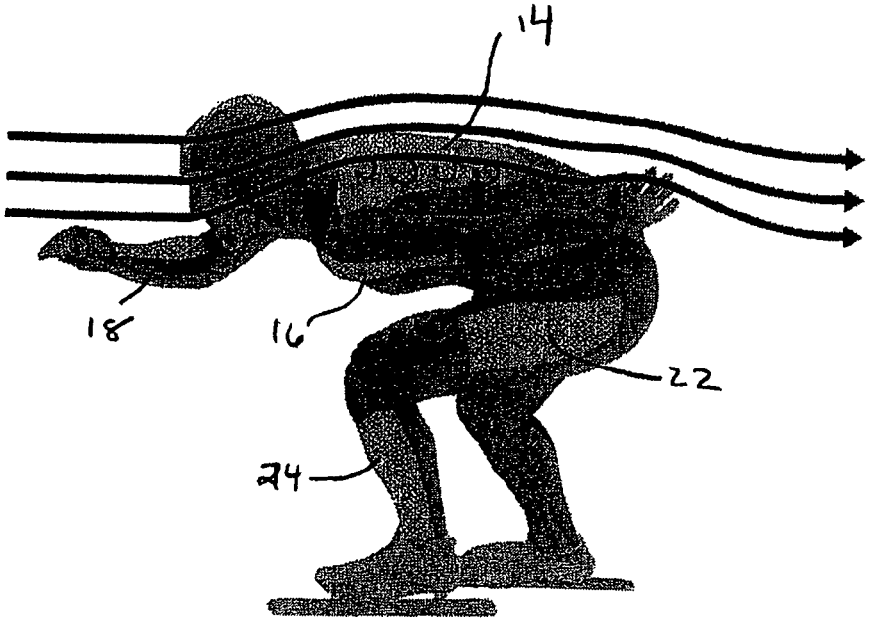
FIG. 4 is a side view of a speed skater in racing position wearing the athletic suit according to the present invention.

These segments enumerated above contain turbulence-generating fabric to increase the drag on an athlete's body. The turbulence generating fabric may be any suitable textured material such as a ribbed-type material wherein the ribs 40 are positioned to provide the desired drag force. For speed skater garment, for example, as shown in FIG. 4, the ribs are positioned on the garment to be approximately perpendicular to the wind when the speed skater is in a speed skating position. The ribs 40 generate turbulence, producing drag or wind resistance, in turn increasing the resistance to the athlete.

Figure 5:
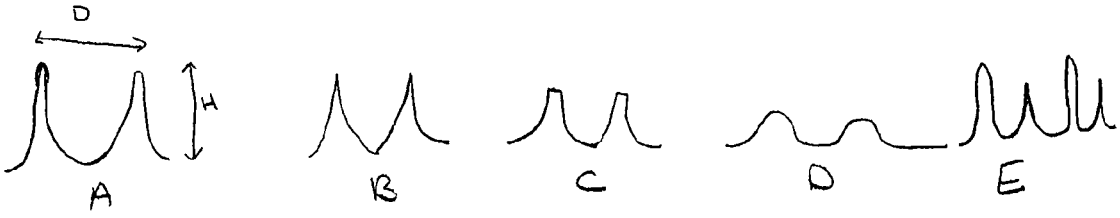
FIG. 5 A-E depict various rib cross-sections

The ribs may be of any suitable dimension and shape to provide the desired drag. For example, the ribs may be pointed, rounded, or squared off projections on the surface of the textile. See FIG. 5. The height (H) of the ribs can be in the range of 1 to 15 millimeters in height, but may be more in other configurations of garment 30. As depicted in FIG. 5, the ribs, when viewed in cross-section, can be any suitable shape and various alternate shapes such as rounded (A), triangular (B), squared (C), tall and skinny (A), short and fat (D), and the like and combinations thereof such as in (E). The ribs may have different sizes and shapes depending upon where they are positioned on the drag suit. The ribs may be spaced any suitable distance (D) apart from each other such as 1 to 15 millimeters, such as 3 to 7 millimeters.

FIG. 4 demonstrates how the body segments correspond to the areas affected by the wind flowing across the body during skating. The ribs are placed in these body segments to take advantage of this flow by creating turbulence in the flow. The ribs are generally oriented perpendicular with respect to air flow but can be slanted toward the air flow as well. Note that the orientation may change if the body position changes. For example, a swinging arm may place the ribs perpendicular to the wind in some orientations and slanted to the wind in other orientations.

Although garment 30 may fit loosely on the individual, various advantages may be gained when garment 30 fits the athlete in a relatively tight manner. For example, the ribs 40 will provide protrusions on the surface of the athlete that are more likely to interface with the flow of air when garment 30 fits tightly. The garment 30 should fit the athlete as tightly as feasible. Consequently, each garment 30 may need to be tailored to the dimensions of the individual athlete and particular athletic event.

A variety of textiles or other fabrics, whether formed from natural or synthetic fibers, may be utilized for garment 30. As examples, garment 30 may incorporate cotton, polyester, Nylon/spandex unlaminated textured tricot, nylon/spandex mesh polyester/spandex unlaminated textured tricot, polyester/spandex laminated textured, polyester/spandex mesh, polyester/spandex tricot, and polyester/spandex velour. In some configurations, garment 30 may be formed from combinations of different textiles.

The garment can have an invisible, bar-tacked, re-enforced, center front zip. A rear zip could also be used. Loop side Velcro™ pads may be attached to or printed on the garment 30, to more effectively secure a race number, if desired.

The body heat of the athlete may be vented or retained at particular locations of his or her body by the use of particular materials and colors. In specific zones, fabric laminates and dark colors may be employed to retain body heat, while in other areas heat may be vented by using mesh and light colors. For example, a dense, elastic laminate may be used on the upper leg to provide heat retention and support, and simultaneously being breathable, elastic, and provide the desired drag aerodynamic. The rear of the upper leg may be made from a dense lightweight material for heat ventilation and flexibility.

In all embodiments, regardless of the preferred fabric, the fabric covering each body segment may incorporate materials that impart elasticity so that garment 30 is tight fitting and stretches. Elastic materials permit the athlete the full range of necessary movement for the specific athletic event. To this end, the fabric utilized in the garment 30 preferably stretches at least 30% in the lengthwise and widthwise directions, but may stretch to a lesser degree in some configurations. For each body segment, the fabric covering the front and the back of the body segment may be different in order to meet the requirements of increased drag and heat retention and ventilation.

This garment provides a resistance training tool that works by increasing the aerodynamic or hydrodynamic drag of athletes as they train for their sport. The garment allows athletes to increase their strength and endurance by increasing the effort that they must exert while training. The garment is particularly beneficial for athletes who train at altitude and want to simulate air resistance at low levels of elevation.

The garment provides an alternative to and improvement over current resistance training devices such as parachutes and resistance bands, by providing, for example, balanced resistance to all segments of the body instead of just the lower torso.

The garment can be donned and doffed easily. This is particularly important for athletes who often wear body suits when they compete such as speedskaters, swimmers, track athletes, as well as others.

The garment utilizes a textured fabric to create surface turbulence. This turbulence-generating fabric comprises a portion of the suit. It can be located in specific areas covering a specific percentage of the suit so as to create a proportional amount of air resistance for each segment of the body as it moves through the fluid during an athlete's training. The tubulance generating fabric can be evenly distributed across all body segments for a more even resistance effect as opposed to, for example, just at the mid section of the torso. The fabric may also be aligned to the direction of the fluid flow to maximize it's effectiveness at creating drag.

The turbulence generating fabric can be a variety of materials and variables such as texture, orientation to the fluid flow, placement, and coverage area can all be adjusted to achieve specifics amounts of fluid drag.

The other sections of the garments that are not constructed with the turbulent generating fabric are made with a stretch material that optimizes comfort and mobility for the athlete. This material may be a stretch polyester/lycra knit, but could also be any other stretch material that would allow freedom of movement for the athlete.

In contrast to other resistance training devices such as parachutes, the garment does not require a harness and large fabric parachute to be attached to the body such as around the waist. The garment further does not require resistance bands that connect the torso to a stationary object or a training partner. Instead, the garment provides ease and comfort of use and the ability to perform one's sport in as close to similar manner as one would while competing. An advantage allows the ability to do a complete training session, without having to adjust devices, or have the training session disrupted.

This garment increases resistance on each body segment proportionally. That is, the garment increases the exertion level of the athlete in a balanced manner over all body segments thus optimizing the resistance workout of the athlete.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An athletic garment comprising:

a first fabric covering at least a portion of a front of a torso of an athlete, a second fabric covering at least a portion of a back of the torso of the athlete, a third fabric covering at least a portion of a first arm of the athlete: and a fourth fabric covering at least a portion of a second arm of the athlete, wherein the athletic garment is tight-fitting;

wherein the second, third and fourth fabrics are a textured turbulence-generating fabric; and wherein turbulence is generated by fluid flow across the second, third and fourth fabrics during movement of the athlete creating fluid resistance on the athlete;

wherein said first and second fabric can stretch at least 30% in both lengthwise and widthwise directions, wherein the textured turbulence-generating fabric is a ribbed fabric, and the ribs of the second fabric extend laterally across the back of the torso, wherein the ribs of the third fabric extend longitudinally along a length of the first arm, wherein the ribs of the fourth fabric extend longitudinally along a length of the second arm.

2. An athletic garment of claim 1, wherein the second fabric is positioned on the garment such that when the athlete is engaged in an athletic activity, the ribs are generally oriented perpendicular to the fluid flow.

3. An athletic garment of claim 1, wherein the third fabric is positioned on the garment such that when the athlete is engaged in an athletic activity, the ribs are generally oriented perpendicular to the fluid flow.

4. An athletic garment of claim 1, wherein the fourth fabric is positioned on the garment such that when the athlete is engaged in an athletic activity, the ribs are generally oriented perpendicular to the fluid flow.

5. An athletic garment of claim 1, wherein said ribs of the third fabric extend along an upper portion of the first arm, a lower portion of the first arm or both an upper and lower portion of the first arm.

6. An athletic garment of claim 1, wherein said ribs of the fourth fabric extend along an upper portion of the second arm, a lower portion of the second arm or both an upper and lower portion of the second arm.

7. An athletic garment of claim 1 wherein a fifth fabric is positioned on two sides of the front of the torso adjacent the first fabric; wherein the fifth fabric is a turbulence-generating fabric.

8. An athletic garment as recited in claim 1 wherein the second fabric creates aerodynamic drag or hydrodynamic drag during movement of the athlete.

9. An athletic garment of claim 1, wherein the athletic garment includes a full body suit which covers the arms and legs of the athlete.

10. An athletic garment of claim 1, further comprising:

a fifth fabric covering at least a portion of a first leg of the athlete; and a sixth fabric covering at least a portion of a second leg of the athlete, wherein the fifth and sixth fabrics are a ribbed, textured turbulence-generating fabric; and wherein turbulence is generated by fluid flow across the fifth and sixth fabrics during movement of the athlete creating fluid resistance on the athlete, wherein the ribs of the fifth fabric extend longitudinally along a length of the first leg, wherein the ribs of the sixth fabric extend longitudinally along a length of the second leg.

11. An athletic garment comprising:

a first fabric for covering at least a portion of a first body segment, and a second fabric, different from said first fabric, for covering at least a portion of a second body segment;

a third fabric, different from the first fabric, for covering at least a portion of a first arm of the athlete: and a fourth fabric, different from the first fabric, for covering at least a portion of a second arm of the athlete, wherein the athletic garment is tight-fitting;

wherein the second, third and fourth fabrics are a textured turbulence-generating fabric;

wherein said first and second fabric can stretch at least 30% in both lengthwise and widthwise directions, wherein the textured turbulence-generating fabric is a ribbed fabric, wherein the ribs of the second fabric extend laterally across a back of a torso of the athlete, wherein the ribs of the third fabric extend longitudinally along a length of the first arm, wherein the ribs of the fourth fabric extend longitudinally along a length of the second arm.

12. The athletic garment of claim 11 wherein the garment produces a higher cumulative coefficient of drag experienced by an athlete in a predetermined event than a garment made entirely from the first fabric.

13. The athletic garment of claim 12, further comprising:

a fifth fabric, different from the first fabric, for covering at least a portion of a first leg of the athlete; and a sixth fabric, different from the first fabric, for covering at least portion of a second leg of the athlete, wherein the fifth and sixth fabrics are a ribbed, textured turbulence-generating fabric; and wherein turbulence is generated by fluid flow across the fifth and sixth fabrics during movement of the athlete creating fluid resistance on the athlete, wherein the ribs of the fifth fabric extend longitudinally along a length of the first leg, wherein the ribs of the sixth fabric extend longitudinally along a length of the second leg.

14. The athletic garment of claim 11, wherein the at least the first fabric has a different surface textures than the other fabrics.

15. An athletic garment of claim 11, wherein the athletic garment includes a full body suit which covers the arms and legs of the athlete.

16. An athletic garment of claim 11, wherein the second fabric is positioned on the garment such that when the athlete is engaged in an athletic activity, the ribs of the second fabric are generally oriented perpendicular to the fluid flow.

17. An athletic garment comprising:

a first fabric for covering at least a portion of a first body segment, a second fabric, different from said first fabric, for covering at least a portion of a second body segment, and a third fabric, different from the first fabric, for covering at least a portion of a third body segment, wherein the athletic garment is tight-fitting;

wherein the second and third fabrics are textured turbulence-generating fabrics;

wherein said first and second fabric can stretch at least 30% in both lengthwise and widthwise directions, wherein the textured turbulence-generating fabrics are ribbed fabrics, and the ribs of the second fabric extend laterally across aback of a torso of the athlete, wherein the ribs of the third fabric extend longitudinally along a length of an arm of the athlete.

18. The athletic garment of claim 17 wherein the garment is structured to produce a higher cumulative coefficient of drag experienced by an athlete in a predetermined event than a garment made entirely from the first fabric.

19. The athletic garment of claim 17 wherein said garment is structured to produce a higher cumulative coefficient of drag experienced by a speed skater while skating than a garment made entirely from said first fabric.

20. The athletic garment of claim 17, wherein said ribs of the third fabric extend along an upper arms, a lower arm or both the upper arm and lower arm.

21. An athletic garment of claim 17, wherein the athletic garment includes a full body suit which covers the arms and legs of the athlete.

22. An athletic garment of claim 17, wherein the second fabric is positioned on the garment such that when the athlete is engaged in an athletic activity, the ribs of the second fabric are generally oriented perpendicular to the fluid flow.

23. An athletic garment of claim 17, further comprising:

a fourth fabric covering at least a portion of a first leg of the athlete; and a fifth fabric covering at least a portion of a second leg of the athlete, wherein the fourth and fifth fabrics are a ribbed, textured turbulence-generating fabric;

and wherein turbulence is generated by fluid flow across the fourth and fifth fabrics during movement of the athlete creating fluid resistance on the athlete, wherein the ribs of the fourth fabric extend longitudinally along a length of the first leg, wherein the ribs of the fifth fabric extend longitudinally along a length of the second leg.

24. An athletic garment comprising:

a first fabric for covering at least a first portion of a body, a second fabric, different from said first fabric, for covering at least a second portion of the body; and a third fabric, different from the first fabric, for covering at least a portion of a leg of the athlete, wherein the athletic garment is tight-fitting;

wherein the second and third fabrics are a textured, turbulence-generating fabric and are evenly distributed over the second and third portions of the body, respectively;

wherein said first and second fabric can stretch at least 30% in both lengthwise and widthwise directions, wherein the textured, turbulence-generating fabric is a ribbed fabric, and the ribs of the second fabric extend laterally across a back of a torso of the athlete, wherein the ribs of the third fabric extend longitudinally along a length of the leg of the athlete.

25. An athletic garment of claim 24, wherein the athletic garment includes a full body suit which covers the arms and legs of the athlete.

26. An athletic garment of claim 24, wherein the second fabric is positioned on the garment such that when the athlete is engaged in an athletic activity, the ribs of the second fabric are generally oriented perpendicular to the fluid flow.

27. An athletic garment of claim 24, further comprising: a fourth fabric, different from the first fabric, for covering at least a portion of an arm of the athlete, wherein the fourth fabric is a ribbed, textured turbulence-generating fabric, wherein turbulence is generated by fluid flow across the fourth fabric during movement of the athlete creating fluid resistance on the athlete, wherein the ribs of the fourth fabric extend longitudinally along a length of the arm.

* * * * *

UNITED STATES PATENT AND TRADEMARK OFFICE

CERTIFICATE OF CORRECTION

PATENT NO. : 7,856,668 B2
APPLICATION NO. : 11/529567
DATED : December 28, 2010
INVENTOR(S) : Nathan Demarest et al.

It is certified that error appears in the above-identified patent and that said Letters Patent is hereby corrected as shown below:

Column 6, Claim 11, Line 10:
Please delete "and"

Column 7, Claim 17, Line 5:
Please delete "aback" and insert -- a back --

Column 7, Claim 20, Line 17:
Please delete "arms" and insert -- arm --

Signed and Sealed this
Twentieth Day of December, 2011

David J. Kappos

David J. Kappos
*Director of the United States Patent and Trademark Office*